United States Patent [19]

Moriya

[11] Patent Number: 4,611,536

[45] Date of Patent: Sep. 16, 1986

[54] APPARATUS FOR PRODUCING A RESET PULSE FOR A PRINTER

[75] Inventor: Mikio Moriya, Tanashi, Japan

[73] Assignee: Citizen Watch Co., Ltd., Tokyo, Japan

[21] Appl. No.: 697,030

[22] Filed: Jan. 31, 1985

[30] Foreign Application Priority Data

Jan. 31, 1984 [JP] Japan ..... 59-011122[U]

[51] Int. Cl.[4] ..... B41J 1/24

[52] U.S. Cl. ..... 101/93.21; 101/93.18; 74/569

[58] Field of Search ..... 101/93.18, 93.21, 93.3, 101/93.35; 74/569, 829, 838

[56] References Cited

U.S. PATENT DOCUMENTS

| | | | |
|---|---|---|---|
| 1,272,018 | 7/1918 | Dietze | 74/569 |
| 2,427,725 | 9/1947 | Hoeber | 74/569 |
| 4,481,839 | 11/1984 | Zullo et al. | 74/569 |

FOREIGN PATENT DOCUMENTS

| | | | |
|---|---|---|---|
| 2347944 | 4/1974 | Fed. Rep. of Germany | 101/93.21 |
| 1436901 | 5/1976 | United Kingdom | 101/93.18 |

*Primary Examiner*—Edgar S. Burr
*Assistant Examiner*—John A. Weresh
*Attorney, Agent, or Firm*—Birch, Stewart, Kolasch & Birch

[57] ABSTRACT

An apparatus for producing a reset pulse for performing the printing operation of an impact printer. A cam is secured to a shaft of a type drum. The cam has a rising portion, lowering portion, and escape portion. A cam follower is mounted on a lever to engage with the cam. The cam follower has a large diameter portion and a small diameter portion, and a reset switch is provided to be operated by the lever to produce a reset pulse when the lever is rocked by the engagement of the cam follower with the lowering portion of the cam.

3 Claims, 7 Drawing Figures

APPARATUS FOR PRODUCING A RESET PULSE FOR A PRINTER

BACKGROUND OF THE INVENTION

The present invention relates to an impact printer for performing impact printing in series, and more particularly to a printer having an adjusting means for a reset pulse producing means.

An impact printer having a type drum provided with a plurality of type characters arranged circumferentially for each column is known. U.S. Pat. No. 3,848,527 discloses such an inpact printer. One cycle of printing operation is initiated by a printing command signal from a printer control circuit and the impact printing is performed in accordance with a print signal from the control circuit. The print signal is produced dependent on a reset pulse and character pulses applied from the printer. In a conventional printer, the reset pulse is produced by a switch responsive to the angular position of the type drum, and the character pulses are obtained by another means. If the timing of the reset pulse does not coincide or synchronize with the timing of the character pulses, desired printing can not be performed. In order to synchronize the reset pulse with the character pulse, it is necessary that the timing of the reset pulse can be adjusted.

SUMMARY OF THE INVENTION

The object of the present invention is to provide a printer with means for producing a reset pulse the timing of which can be easily and finely adjusted.

According to the present invention, there is provided an apparatus for producing a reset pulse for performing the printing operation of an impact printer, the printer having a type drum, a plurality of hammers urged by springs to the type drum, a plurality of electromagnets for holding the hammers in a retracted position and for releasing the hammers by a signal dependent on the reset pulse, and a reset cam for moving each hammer to perform printing operation. The apparatus comprises a reset lever provided to be rocked, a cam secured to a shaft of the type drum, the cam having an actuating portion and an escape portion, a cam follower mounted on the reset lever to engage with the cam, the cam follower having a large diameter portion and a small diameter portion corresponding to the actuating portion and escape portion, and a reset switch provided to be operated by the reset lever to produce the reset pulse when rocked by the engagement of the cam follower with the actuating portion of the cam.

In one aspect of the present invention, the actuating portion of the cam comprises a rising portion and lowering portion, and the reset switch is operated by the engagement of the cam follower with the lowering portion.

These and other objects and features of the present invention will become more apparent from the following description with reference to the accompanying drawings.

DESCRIPTION OF THE PREFERRED EMBODIMENTS

Figure 1:
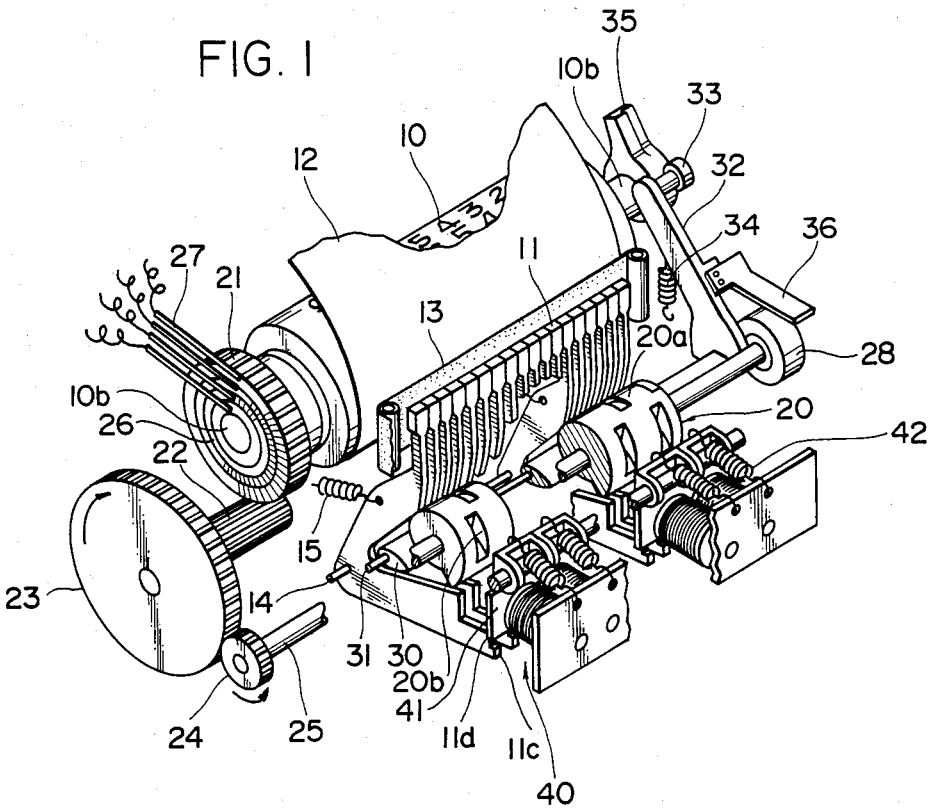
FIG. 1 is a perspective view showing a printer to which the present invention is applied.
Figure 2:
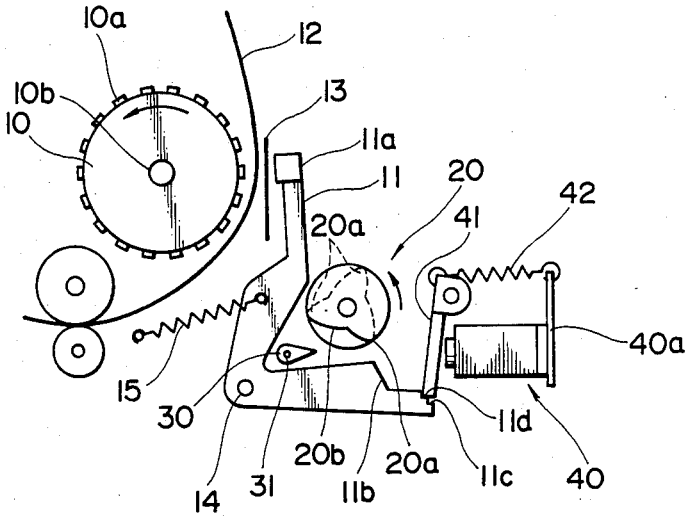
FIG. 2 is a schematic side view of the printer.

Referring to FIGS. 1 and 2, a type drum 10 rotatably supported on a frame (not shown) by a shaft 10*b* is adapted to be driven by a motor (not shown). The type drum 10 has a plurality of type characters 10*a* circumferentially formed on the outer periphery thereof in columns. The type characters are arranged in groups each of which comprises three columns and phase between the adjacent columns is different from each other by one-third of a pitch between characters on a column.

A gear 21 secured to the shaft 10*b* of the type drum 10 is engaged with a pinion 22. The pinion 22 is integral with a gear 23 which is engaged with a gear 24 secured to a reset cam shaft 25 of a reset cam 20. The gear ratio of the gear train is set such that the reset cam 20 completes one rotation for one type character pitch of the type drum 10. The reset cam 20 has a lobe 20*a* and a recess 20*b* at each column. A type character position detecting disk 26 having a pattern corresponding to the phase difference of the type character is secured to a side of the gear 21. A plurality of detecting contacts 27 are disposed adjacent the disk 26 for detecting a position of each type character.

A plurality of print hammers 11 rotatably supported on a shaft 14 are disposed adjacent the type drum 10 arranged in the axial direction thereof. Each print hammer 11 is biased towards the type drum 10 by a spring 15. Each print hammer 11 has a hammer head 11*a* at one end portion, a reset projection 11*b*, a first locking hook 11*c* and a second locking hook 11*d* at the other end portion.

An armature 41 associated with an electromagnet 40 is disposed adjacent print hammers 11 and is provided for a group of three adjacent hammers 11 for three adjacent columns of type characters. The armature 41 is urged in the clockwise direction by a spring 42 provided between an end of the armature and a magnet support plate 40*a* so that the other end of the armature 41 is adapted to engage with the first locking hook 11*c* or the second locking hook 11*d*. When the armature 41 is engaged with the first locking hook 11*c*, the hammer 11 is held in the waiting position adjacent the type drum, and when the armature 41 is engaged with the second locking hook 11*d*, the hammer 11 is held in the retracted position as shown in FIG. 2.

A recording paper 12 and an inked ribbon 13 are inserted between the type drum 10 and hammers 11 in the well known manner.

A retracting cam 30 rotatably supported by a shaft 31 is disposed adjacent the hammers 11 so as to move all of the hammers 11 to the retracted position at the same time. Secured to the other end of the shaft 31 is a reset lever 32 provided with a cam follower 33 which is rotatably and detachably attached to an upper end portion of the reset lever. The cam follower 33 is engaged with a cam 35 secured to the other end of the type drum shaft 10*b* by means of a suitable means such as a key and a screw. Thus, the retracting cam 30 is coupled with the cam 35 through the reset lever 32 and rotated at every one rotation of the type drum 10, that is, per one printing cycle, to retract all hammers. A braking lever 36 secured to the reset lever 32 is engaged with a brake wheel 28 securely mounted on the other end of the reset cam shaft 25.

Figure 3:
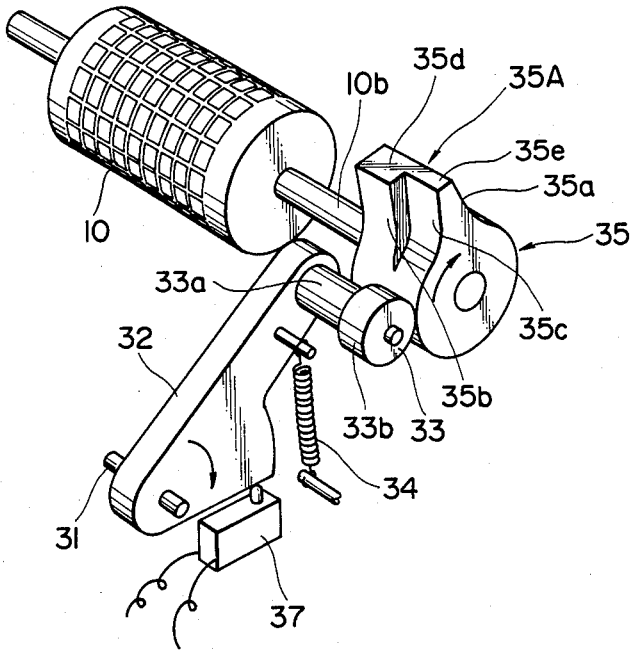
FIG. 3 is a partly enlarged perspective view of the printer.

Referring to FIG. 3, the cam 35 has a lobe 35A. The lobe 35A comprises a common rising portion 35*a* for elevating the reset lever 32, a lowering portion 35*b* for deciding a timing of a reset pulse generation, and an escape portion 35*c*. A top surface 35*d* corresponding to the lowering portion 35*b* has a wider surface than that of a top surface 35*e* of the escape portion 35*c*.

The cam follower 33 comprises a small diameter portion 33*a* corresponding to the lowering portion 35*b* of the cam 35 and a large diameter portion 33*b* corresponding to the escape portion 35*c*.

A spring 34 secured to the reset lever 32 is provided to urge the reset lever 32 in the clockwise direction of FIG. 3. A reset switch 37 provided under the reset lever 32 is actuated by the lever to produce a reset pulse at every one rotation of the type drum 10.

Figure 5:
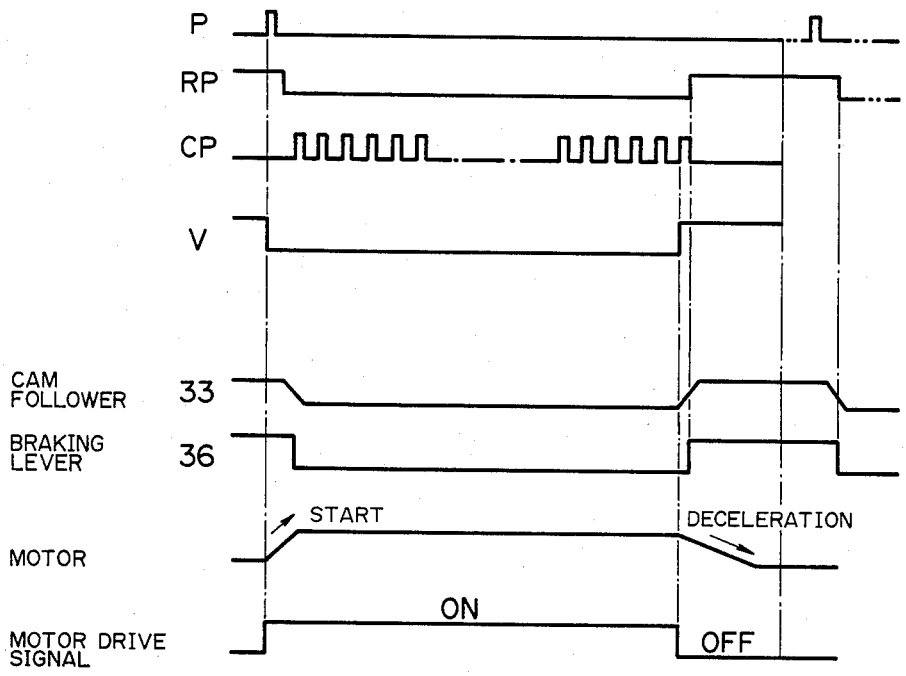
FIG. 5 is a timing chart showing operation of the printer.

Describing the operation of the printer with reference to FIG. 5, the cam follower 33 is on the tops 35*d* and 35*e* of the cam 35, before the start of the motor. A printer control circuit (not shown) produces a printing command signal P at every printing cycle, so that a motor control signal V goes to a low level and a motor drive signal is generated to rotate the type drum 10.

Figure 4A:
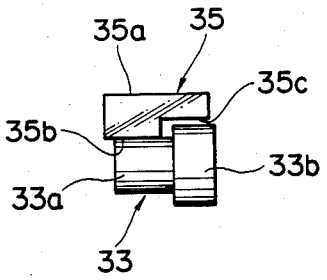
FIGS. 4*a* and 4*b* are side views showing an engagement of the present invention.

When the cam 35 is rotated in the direction of the arrow of FIG. 3, the large diameter portion 33*b* of the cam follower 33 disengages from the top surface 35*e* and the small diameter portion 33*a* disengages from the top 35*d*, then the small diameter portion 33*a* engages with the lowering portion 35*b*, but the large diameter portion does not engage with the escape portion 35*c*, as shown in FIG. 4*a*. The reset lever 32 is rotated in the clockwise direction in FIG. 3. When the reset lever 32 reaches a predetermined level, it depresses the switch 37 to produce the reset pulse RP. Immediately after the generation of the reset pulse RP, detecting contacts 27 produce character pulses CP representing the position of each type character. The printer control circuit operates to serially generate a print signal dependent on a corresponding character pulse to produce a reset signal for a corresponding type character at every group of columns. The reset signal energizes the electromagnet 40 to attract the armature 41 to release the hammer 11. When the hammer 11 is released, the reset projection 11*b* engages with the lobe 20*a* of the reset cam 20, thereafter the projection 11*b* falls in the recess 20*b*, so that the hammer head 11*a* strikes the type character to print the type on the paper 12. After that, cam lobe 20*a* rocks the hammer 11 in the clockwise direction in FIG. 2, so that the first hook 11*c* engages with the armature 41. Thus, the hammer is held at the waiting position.

When the printing of one cycle (one line) finishes, the large diameter portion 33*b* of the cam 33 engages with the rising portion 35*a* of the cam 35, thereby elevating the reset lever 32 to turn off the reset switch 37. Thus, the motor drive signal disappears to stop the motor. On the other hand, the shaft 31 and retracting cam 30 rotate in the clockwise direction in FIG. 2, so that all hammers are rocked, resulting in engagement of the second hooks 11*d* with the armature 41 to hold the hammers at the retracted position shown in FIG. 2. At the same time, the engaging lever 36 is engaged with the brake wheel 28 to stop the reset cam 20.

Figure 4B:
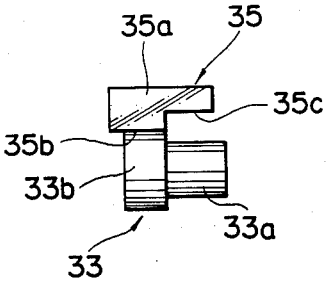

FIG. 4*b* shows another use of the cam follower 33, in which the cam follower 33 of the present invention is reversely attached to the reset lever 32 in which the small diameter portion 33*a* corresponds to the escape portion 35*c* and the large diameter portion 33*b* corresponds to the lowering portion 35*b*. Thus, operating timing of the switch 37, that is the timing of the generation of reset pulse RP, is retarded compared with the timing of FIG. 4*a*.

Figure 6:
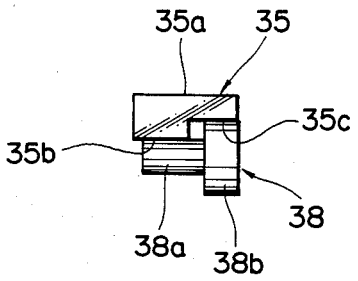
FIG. 6 shows modification of a cam follower in the printer according to the present invention.

FIG. 6 shows a modification of the cam follower. A cam follower 38 has a smaller diameter portion 38*a* smaller than the small diameter portion 33*a* of the cam follower 33 in diameter. Accordingly, the timing of the generation of the reset pulse RP is advanced compared with FIG. 4*a*.

Thus, in accordance with the present invention, the timing of the reset pulse can be easily and finely adjusted.

While the invention has been described in conjunction with preferred specific embodiments thereof, it will be understood that this description is intended to illustrate and not limit the scope of the invention, which is defined by the following claims.

What is claimed is:

1. In an apparatus for producing a reset pulse for performing a printing operation of an impact printer, the printer having a type drum, a plurality of hammers urged by springs to the type drum, a plurality of electromagnets for holding the hammers in retracted positions and for releasing the hammers by a signal dependent on the reset pulse, and a reset cam for operating a reset switch for moving each hammer to perform said printing operation, the improvement comprising:

a reset lever provided to be rocked;

a reset cam secured to a shaft of the type drum, said cam having an actuating portion and an escape portion, both portions being different in cam lift;

a cam follower mounted on said reset lever to engage with said cam, said cam follower having a large diameter portion and a small diameter portion corresponding to said actuating portion and escape portion; and a reset switch provided to be operated by said reset lever to produce a reset pulse when rocked by the engagement of said cam follower with the actuating portion of said cam, said cam follower being detachably attached to said reset lever so as to be attached in reverse, whereby print timing is changed.

2. The apparatus according to claim 1, wherein said actuating portion of said cam comprises a rising portion and a lowering portion.

3. The apparatus according to claim 2, wherein said reset switch is operated by the engagement of the cam follower with said lowering portion of the actuating portion of said reset cam.

* * * * *